US008382505B2

(12) United States Patent
Park

(10) Patent No.: US 8,382,505 B2
(45) Date of Patent: Feb. 26, 2013

(54) ARC-PREVENTING APPARATUS FOR SEPARATE CORD-TYPE HAIR DRYER

(75) Inventor: Byoung Jin Park, Paju-si (KR)

(73) Assignee: INP. Co., Ltd., Bucheon (KR)

( * ) Notice: Subject to any disclaimer, the term of this patent is extended or adjusted under 35 U.S.C. 154(b) by 0 days.

(21) Appl. No.: 13/121,626

(22) PCT Filed: Sep. 29, 2009

(86) PCT No.: PCT/KR2009/005577

§ 371 (c)(1),
(2), (4) Date: Mar. 29, 2011

(87) PCT Pub. No.: WO2010/038971

PCT Pub. Date: Apr. 8, 2010

(65) Prior Publication Data

US 2011/0177711 A1 Jul. 21, 2011

(30) Foreign Application Priority Data

Sep. 30, 2008 (KR) ..... 10-2008-0095838

(51) Int. Cl.
*H01R 13/627* (2006.01)

(52) U.S. Cl. ..... 439/352; 439/181

(58) Field of Classification Search ..... 439/347, 439/352, 181

See application file for complete search history.

(56) References Cited

U.S. PATENT DOCUMENTS 4,345,122 A * 8/1982 Janniello ..... 200/50.29
5,619,397 A * 4/1997 Honda et al. ..... 361/679.43
6,314,236 B1 11/2001 Taylor
6,454,589 B1 * 9/2002 Yeh ..... 439/352
7,381,079 B2 * 6/2008 Chuang ..... 439/352
7,567,058 B2 * 7/2009 Shimizu et al. ..... 320/114

FOREIGN PATENT DOCUMENTS

JP 5251137 A 9/1993
KR 10-2003-0013312 A 2/2003

OTHER PUBLICATIONS

International Search Report for PCT Application No. PCT/KR2009/005577. Korean Intellectual Property Office. Apr. 29, 2010.

* cited by examiner

*Primary Examiner* — Gary F. Paumen

(57) ABSTRACT

The present invention provides an arc-preventing apparatus for separate cord-type hair dryer to prevent from being damaged by an arc which is occurred when a male connector formed at one end of a separate-type power source cord is disconnected to a female connector installed in a main body of the hair dryer under a load condition. The arc-preventing apparatus is installed in a power contact unit of the hair dryer, and the male and the female connector are fixed or released by an on/off switch of the hair dryer. The arc-preventing apparatus comprises a stopper formed in one side of the female connector which is installed in the power contact unit of the main body, and protruded or retracted by a first elastic body; a rod inserted into a rotation shaft formed in the side opposite to the stopper, and rotates by a predetermined angles along a second elastic body and a guide groove, as the on/off switch is moved down; and a male connector having a first and a second stopping groove which are coupled to a stopping protrusion formed in one end of the rod and the stopper, respectively.

2 Claims, 6 Drawing Sheets

ARC-PREVENTING APPARATUS FOR SEPARATE CORD-TYPE HAIR DRYER

PRIORITY

The present application claims priority under 35 U.S.C. §371 to PCT Application PCT/KR2009/005577, filed on Sep. 29, 2009, which claims priority to Korean Patent Application No. 10-2008-0095838, filed on Sep. 30, 2008, the disclosures of which are hereby incorporated by reference in their entireties.

BACKGROUND OF THE INVENTION

1. Field of the Invention

The present invention relates to an arc-preventing apparatus for separate cord-type hair dryer. Concretely, the present invention relates to an arc-preventing apparatus to prevent a hair dryer or humans from being damaged by an arc, which is occurred every time when a male connector formed at one end of a separate-type power source cord is disconnected to a female connector installed in a main body of the hair dryer under a load condition.

2. Description of the Related Arts

Generally, some electronic products such as a hair dryer consume more power and need a power source cord separated from a main body. There is a problem that an arc may be occurred in contacting points between a power connector of the power source cord (for example, a male connector) in which initial inrush current is immediately generated and a connector of the main body (for example, a female connector). The arc may be occurred because the power is supplied to the power supply circuit of the dryer at the moment the power connector is connected to the connector of the main body.

The arc depends upon load current, supply voltage, separation speed, characteristics of load (resistive, inductive and capacitive load), and so on.

Even if a rated current is supplied and the supplied current is cut off slowly, the arc may be occurred when the connectors are disconnected under a load condition, and the hair dryer or humans can be damaged by the arc.

SUMMARY OF THE INVENTION

The present invention has been developed to solve the problems with above-described separate cord-type hair dryer.

It is an object of the present invention to provide an arc-preventing apparatus capable of preventing an arc from occurring in electronic products such as a separate cord-type hair dryer which consume more power.

It is another object of the present invention to provide an arc-preventing apparatus which has simple structure and low production costs.

It is still another object of the present invention to provide an arc-preventing apparatus capable of preventing an arc which may be occurred by a user's carelessness.

Further objects will become apparent from the drawings and from the following detailed description.

In accomplishing the above and other objectives, an arc-preventing apparatus for separate cord-type hair dryer according to the present invention prevents from being damaged by an arc which is occurred every time when a male connector formed at one end of a separate-type power source cord is disconnected to a female connector installed in a main body of the hair dryer under a load condition.

The arc-preventing apparatus is installed in a power contact unit of the hair dryer, and the male and the female connector are fixed or released by an on/off switch of the hair dryer.

The arc-preventing apparatus comprises a stopper formed in one side of the female connector which is installed in the power contact unit of the main body, and protruded or retracted by a first elastic body; a rod inserted into a rotation shaft formed in the side opposite to the stopper, and rotates by a predetermined angles along a second elastic body and a guide groove, as the on/off switch is moved down; and a male connector having a first and a second stopping groove which are coupled to a stopping protrusion formed in one end of the rod and the stopper, respectively.

Further, the arc-preventing apparatus comprises a female connector housing having an elastic piece formed in one side thereof and an opening formed in the other side thereof, in which the elastic piece is expanded as the male connector is inserted and returned as the male connector is released, in which a stopping protrusion is formed in the elastic piece; and a rod rotating on a rotation shaft by a predetermined angle as the on/off switch is moved down, while being biased the elastic force of the second elastic body, in which one end of the rod is inserted into and released from the opening.

The arc-preventing apparatus for separate cord-type hair dryer according to the present invention prevents a hair dryer or humans from being damaged by an arc which is occurred when a male connector formed at one end of a separate-type power source cord is disconnected to a female connector installed in a main body of the hair dryer under a load condition.

Further, the arc-preventing apparatus protects electronic products or humans safely from the arc with simple structure and low production costs.

DETAILED DESCRIPTION OF THE EMBODIMENTS

Figure 1:
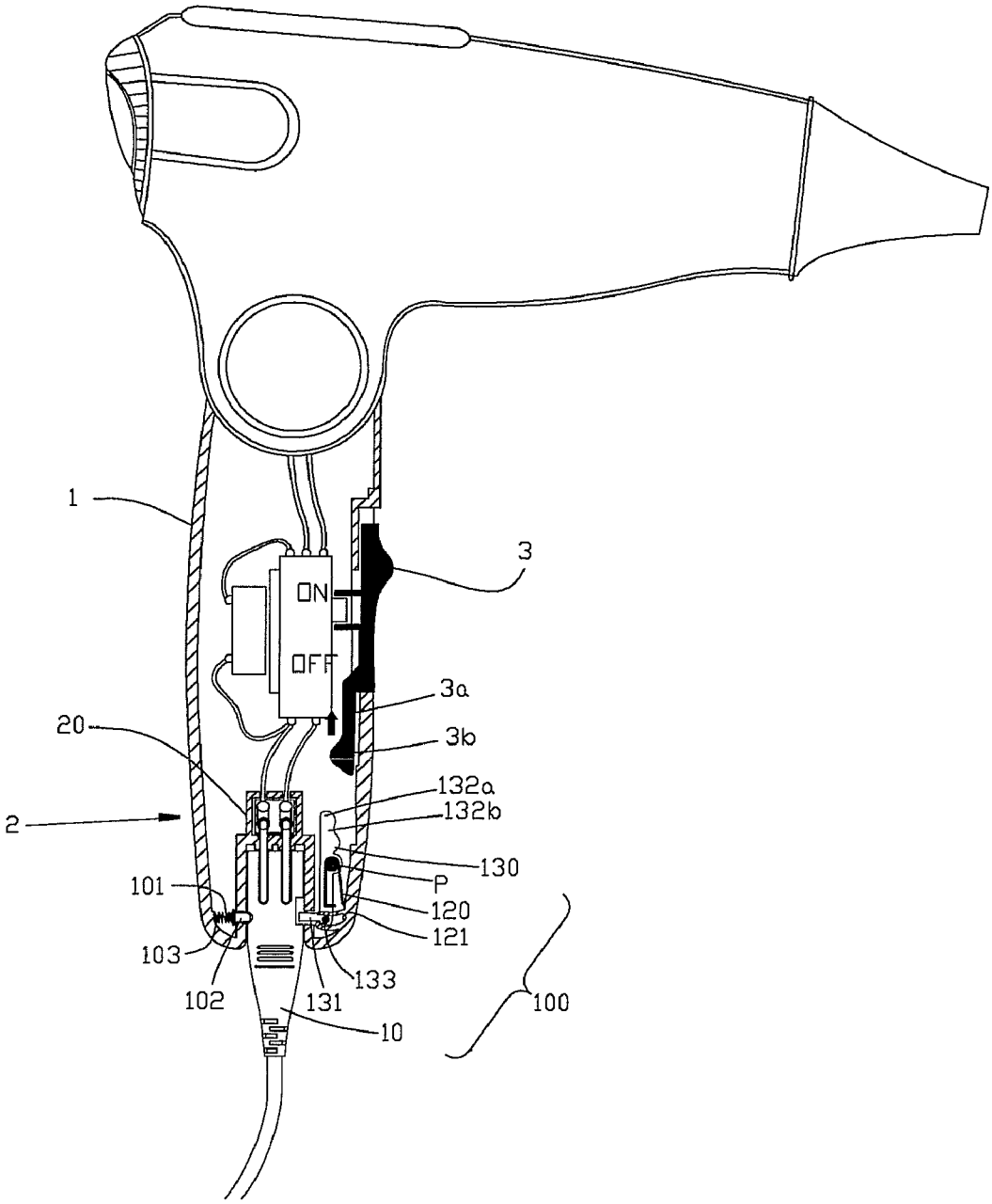
FIG. 1 is a cross-sectional view showing the arc-preventing apparatus for separate cord-type hair dryer according to an embodiment of the present invention.

Referring now to attaching the drawings, an arc-preventing apparatus for separate cord-type hair dryer according to an embodiment of the present invention will be described in detail. It is noted that like parts are designated by like reference numerals throughout the accompanying drawings.

Figure 2:
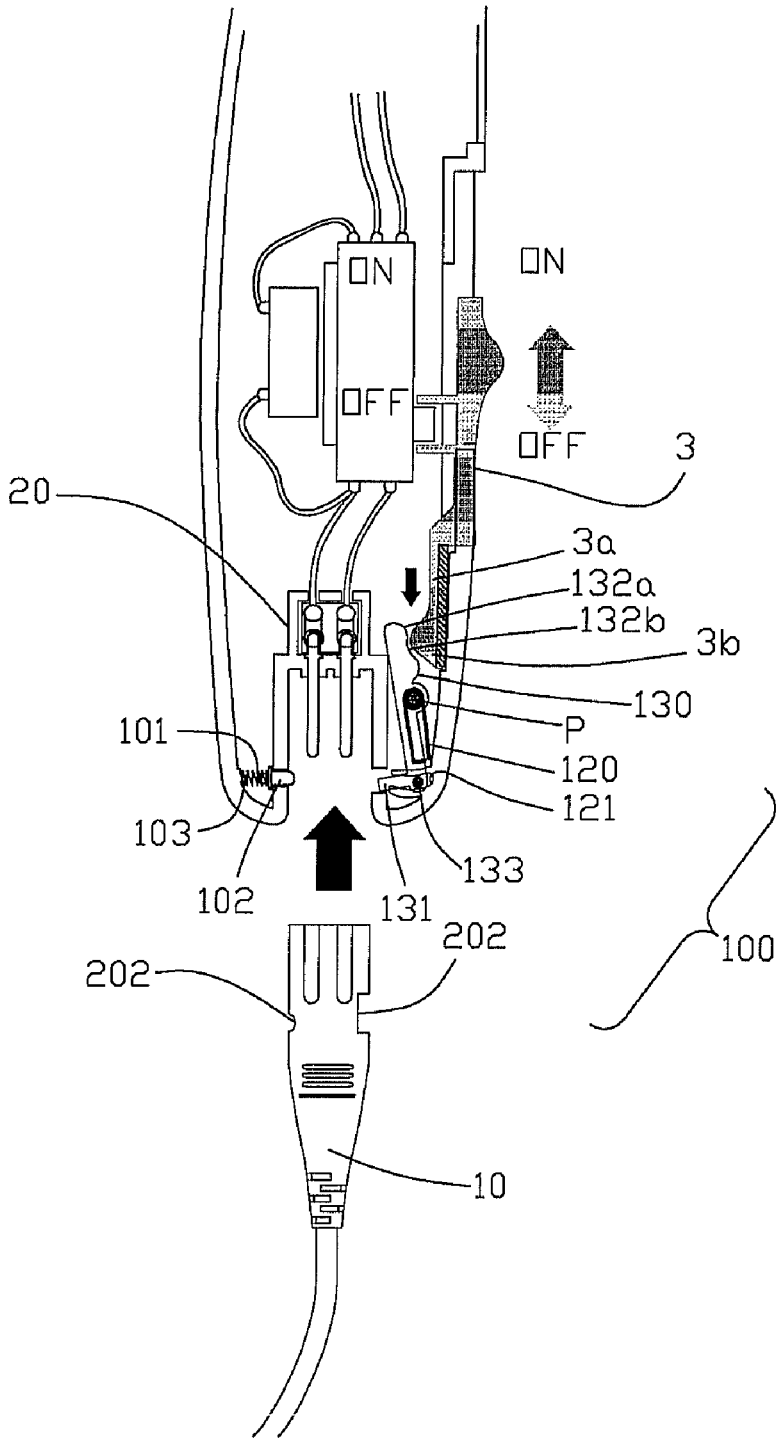
FIG. 2 is a cross-sectional view showing the arc-preventing apparatus and a power source cord according to the present invention, where the power source cord is disconnected from the hair dryer.
Figure 3:
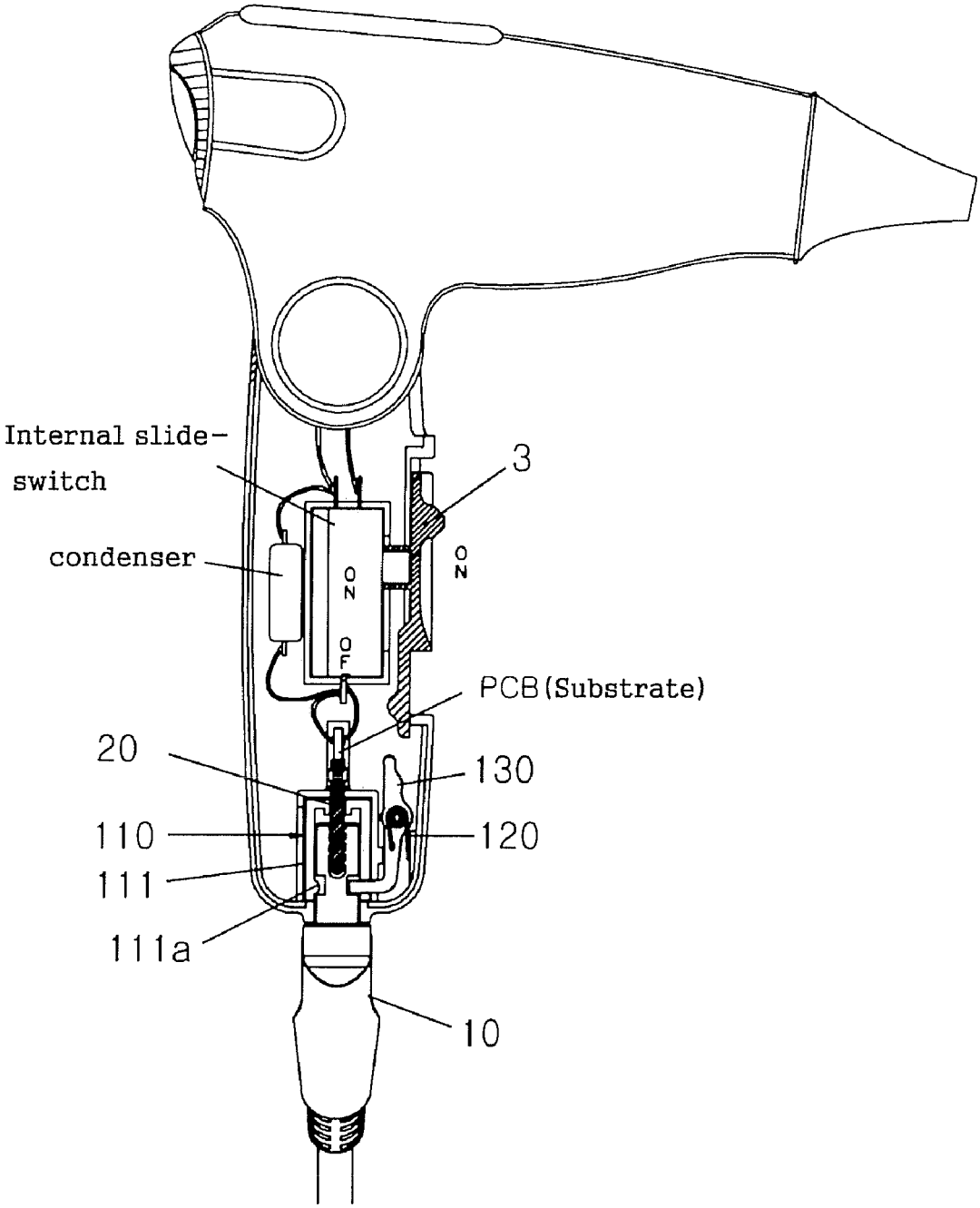
FIG. 3 is a cross-sectional view showing the arc-preventing apparatus for separate cord-type hair dryer according to another embodiment of the present invention, where the power source cord is connected to the hair dryer.

FIG. 1 is a cross sectional view showing the arc-preventing apparatus for separate cord-type hair dryer according to the present invention, and FIG. 2 is a cross sectional view showing the arc-preventing apparatus and a power source cord, where the power source cord is disconnected from the hair dryer.

The hair dryer includes a main body 1 and a power source code. The main body 1 has a power contact unit 2 for receiving power and an on/off switch 3 for turning on or off the supply of power. The power contact unit 2 comprises a female connector 20 and an arc-preventing apparatus 100 controlled by the on/off switch 3.

The female connector 20 of the power contact unit 2 and a male connector of the power source cord are fixed or released firmly by the arc-preventing apparatus 100, thereby reducing the arc occurred when the female connector 20 is separated from the male connector under a load condition.

As shown FIG. 2, the arc-preventing apparatus 100 comprises: a stopper 102 formed in one end of the female connector 20 which is installed in the power contact unit 2 of the main body 1, and protruded or retracted by a first elastic body 101; a rod 130 inserted into a rotation shaft P formed in the side opposite to the stopper 102, and rotates by a predetermined angles along a second elastic body 120 and a guide groove 121, as the on/off switch 3 is moved down; and a male connector 10 having a first and a second stopping groove 201, 202 which are coupled to a stopping protrusion 131 formed in one end of the rod 130 and the stopper 102, respectively.

The first elastic body 101 is a compression spring whose one end is fixed in a protrusion 103 protruded on the inside of the main body 1 and whose the other end is fixed in one end of the stopper 102. The first elastic body 101 is contracted and expanded at a fixed rate in response to the horizontal-direction moving of the stopper 102.

Further, the on/off switch 3 has a long push stick 3*a* in one end thereof, and the long pushing stick 3*a* has a rounded protrusion 3*b* in one end thereof. The rod 130 has an extension part 132 in one end thereof, and the extension part 132 comprises a pushing protrusion 132*a* and a rounded groove 132*b*.

The pushing stick 3*a* of the on/off switch 3 goes through the pushing protrusion 132*a* and stops in the rounded groove 132*b*. Then, the stopping protrusion 131 formed in one end of the rod 130 is bent in L-shape from the rod 130. A guide pin 133 is formed at an intersecting point between the stopping protrusion 131 and the rod 130, so that the stopping protrusion 131 can be moved smoothly along the guide groove 121.

The guide groove 121 is formed in an arc-shape, and one side of the guide groove 121 is opened to the female connector 20.

The second elastic body 120 is a return spring whose one side is fixed in the rod 130 and the other side is supported by the inside of the main body 2. The second elastic body 120 returns the rod 130 which rotates on the rotation shaft P by operating the on/off switch 3, to the initial state.

Further, the first and the second stopping groove 201, 202 are formed in both sides of one end of the male connector 10, and coupled with the stopping protrusion 131 installed one end of the rod 130 and the stopper 102.

The first stopping groove 201 has a size enough to insert and fix smoothly the stopper 102. The first stopping groove 201 is formed in the position in which it is can be fixed automatically, after the male connector 10 is inserted sufficiently into the female connector 20.

Further, the second stopping groove 202 is formed to the position on the same line the first stopping groove 201 is positioned. The second stopping groove 202 has a long-opening shape enough to insert the male connector 10 into the female connector 20 sufficiently, and is not interfered with the rotation of the stopping protrusion 131 formed in one end of the rod 130.

Hereinafter, referring to FIG. 1, the operation of the arc-preventing apparatus for separated cord-type hair dryer according to an embodiment of the present invention will be described in detail.

In case that the arc-preventing apparatus 100 is installed under the on/off switch 3 of the hair dryer, as shown FIG. 2, when the male connector 10 is inserted toward a power contact unit 2 of the main body 1, the stopper 102 formed in the main body 1 goes back with being biased by the elastic force of the first elastic body 101. If the first and the second stopping groove 201, 202 of the male connector 10 are reached to the position in which the stopper 102 is formed, the first stopping groove 201 is coupled with the stopper 102.

At this point, the male connector 10 is completely inserted into the female connector 20.

In the state that the male connector 10 and the female connector 20 are coupled each other completely, if the on/off switch 3 is turned on, the rod 130 is released from the rounded protrusion 3*b* of the long pushing stick 3*a*. The released rod 130 is returned to the initial state by the elastic force of the second elastic body 120. In the course of returning of the rod 130, the stopping protrusion 131 formed in one end of the rod 130 is moved and coupled to the second stopping groove 202 of the male connector 10, along the guide groove 121 with being guided by the guide pin 133.

In the coupled state, the male and the female connector 10, 20 are fixed concretely so that an arc is not occurred between the connectors. After using the dryer, if the on/off switch 3 is turned off, the rounded protrusion 3*b* of the long pushing stick 3*a*, as shown FIG. 2, reaches at the rounded groove 132*b* through the pushing protrusion 132*a* of the extension part 132 formed in one end of the rod 130, and the rod 130 rotates by a predetermined angle with being biased by the second elastic body 120.

Then, the stopping protrusion 131 coupled to the second stopping groove 202 of the male connector 10, is moved along the guide groove 121 with being guided by the guide pin 133. At this point, the male connector 10 can be separated from the female connector 20.

Figure 4:
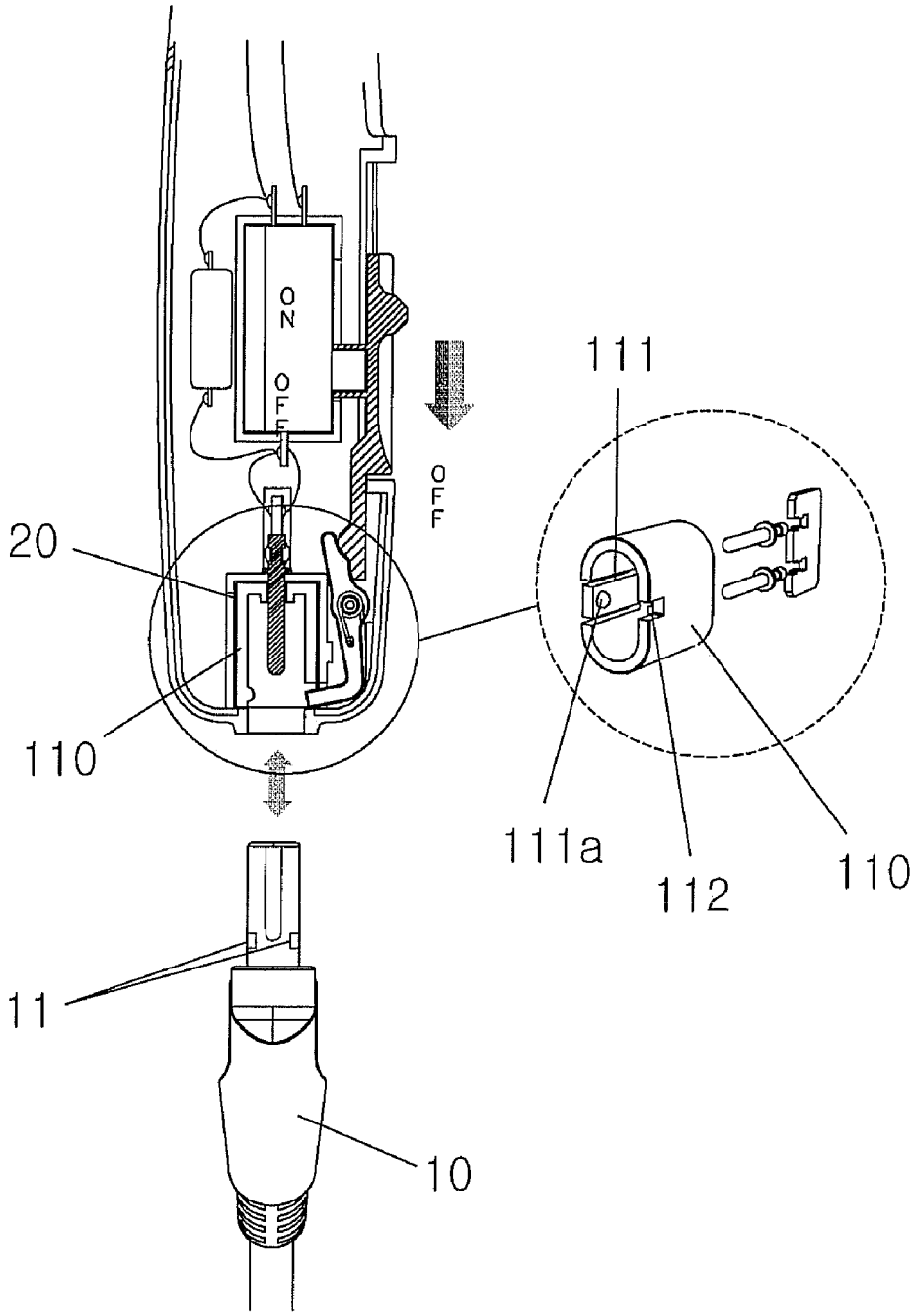
FIG. 4 is a cross-sectional view showing the arc-preventing apparatus for separate cord-type hair dryer according to another embodiment of the present invention, where the power source cord is disconnected from the hair dryer.
Figure 5:
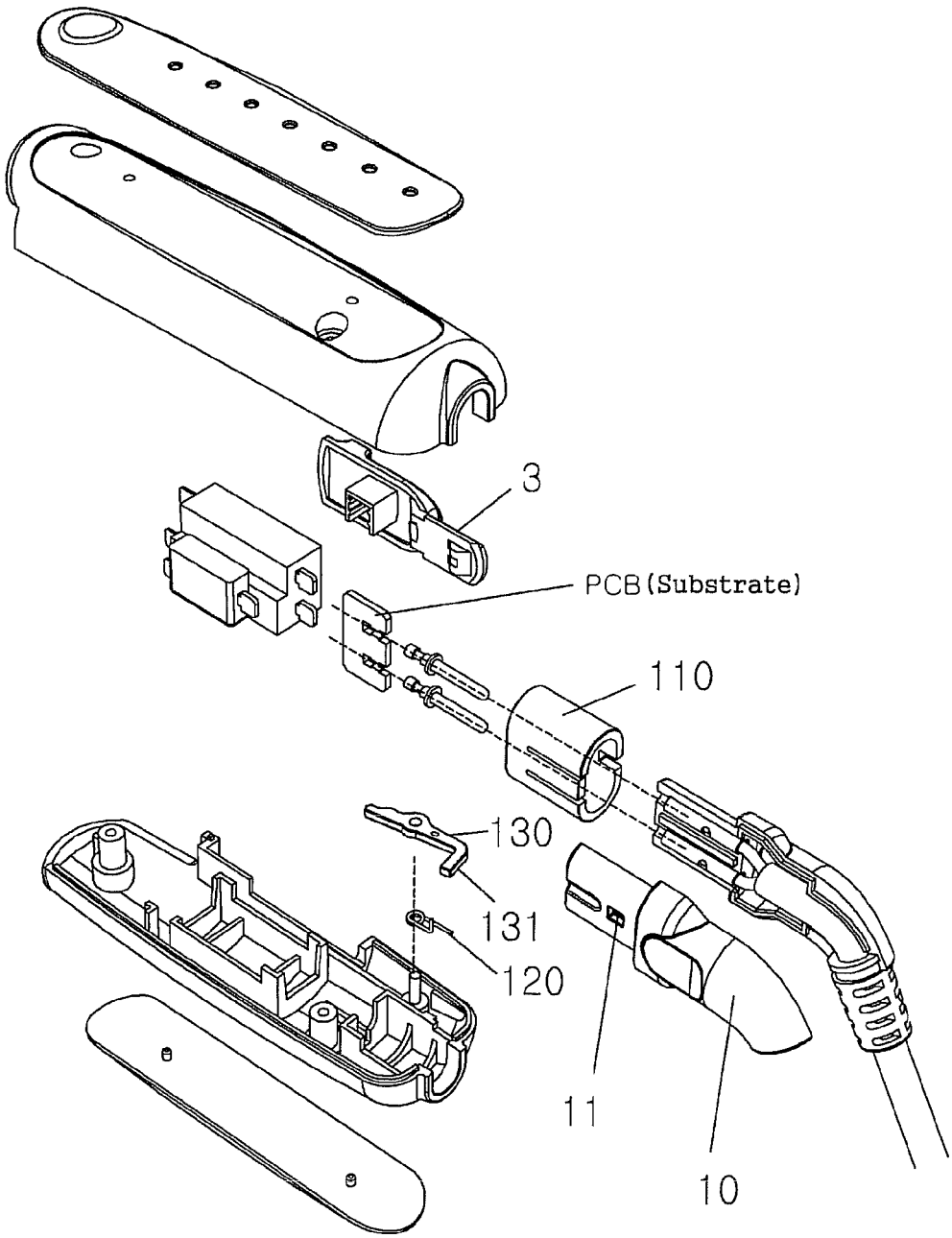
FIG. 5 is a partial magnifying view showing a portion of the FIG. 3.

The arc-preventing apparatus for separate cord-type hair dryer according to another embodiment of the present invention is shown in FIGS. 4 and 5.

As shown FIG. 4 or 5, the arc-preventing apparatus comprises a female connector housing 110 and a rod 130. The female connector housing 110 has an elastic piece 111 formed in one side thereof and an opening 112 formed in the other side thereof. The elastic piece 111 is expanded as the male connector 10 is inserted, and returned as the male connector 10 is released. Further, the elastic piece 111 has a stopping protrusion 111*a* therein.

As the on/off switch 3 is moved down, the rod 130 rotates on a rotation shaft P by a predetermined angle while being biased the elastic force of the second elastic body. One end of the rod 130 is inserted into and released from the opening.

The rod 130 has a stopping protrusion 131 formed as an almost L-shape and as one body in one end thereof.

Further, a stopping groove 11 is formed in both sides of the male connector 10 inserted into the female connector housing 110. The stopping protrusion 111*a* formed in the female connector housing 110 and the stopping protrusion 131 formed in one end of the rod 130 are inserted into the stopping groove 11.

Figure 6:
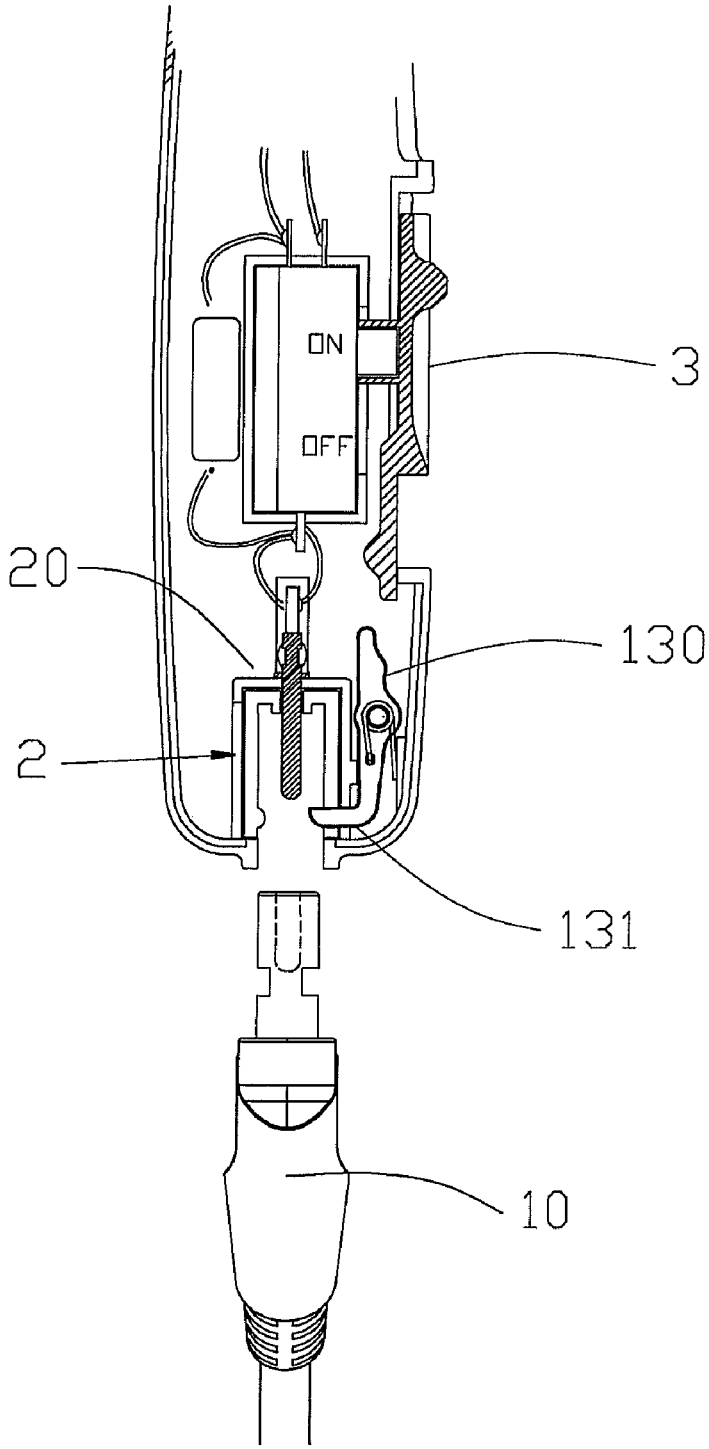
FIG. 6 is a cross-sectional view showing the arc-preventing apparatus for separate cord-type hair dryer according to still another embodiment of the present invention.

The arc-preventing apparatus for separate cord-type hair dryer according to still another embodiment of the present invention is shown in FIG. 6.

The stopping protrusion 131 formed as an almost L-shape and as one body in one end of the rod 130 has a rounded lower end. Therefore, when inserting the male connector 10, the stopping protrusion 131 is pushed back smoothly and coupled to the stopping groove of the male connector 10.

When the on/off switch 3 is turned on, the male connector 10 cannot be separated from the female connector 29, and only when turned off, the male connector 10 can be separated.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An arc-preventing apparatus for preventing a separate cord-type hair dryer from being damaged by an arc, the arc-preventing apparatus comprising:

a male connector having a first stopping groove and a second stopping groove;

a female connector housing having an elastic piece formed in one side thereof and an opening formed in the other side thereof, in which the elastic piece is expanded as the male connector is inserted and returned as the male connector is released, in which a stopping protrusion is formed in the elastic piece;

a stopper being formed in one side of the female connector which is installed in a power contact unit of the main body of the hair dryer, and protruded or retracted by a first elastic body; and a rod being inserted into a rotation shaft formed in the side opposite to the stopper, wherein the rod rotates on the rotation shaft by the predetermined angle along a second elastic body and a guide groove as an on/off switch of the hair dryer is moved down, while being biased the elastic force of the second elastic body, in which one end of the rod is inserted into and released from the opening, and wherein the first stopping groove and the second stopping groove are coupled to the stopping protrusion formed in one end of the rod and the stopper, respectively, and wherein the separate cord-type hair dryer is damaged by the arc when the male connector formed at one end of a separate-type power source cord is disconnected from the female connector installed in the main body of the hair dryer under a load condition, and wherein the arc-preventing apparatus is installed in the power contact unit of the hair dryer, and the male and the female connector are fixed or released by the on/off switch of the hair dryer.

2. The arc-preventing apparatus according to claim 1, wherein the rod having the stopping protrusion formed as an L-shape and in one end of the rod, in which a lower end of the stopping protrusion is rounded so that the stopping protrusion is pushed back smoothly and coupled when inserting the male connector, in which the male connector cannot be separated from the female connector when the on/off switch is turned on, and in which the male connector can be separated only when the on/off switch is turned off.

* * * * *